United States Patent [19]

Peschel

[11] Patent Number: 4,862,691

[45] Date of Patent: Sep. 5, 1989

[54] PUMP DRIVE SPEED REGULATOR WITH CONTROL-PRESSURE-GENERATING VALVE HAVING SPRING BIASED BY CAM FACE ON LOAD DIRECTIONAL CONTROL VALVE

[75] Inventor: Werner Peschel, Lohr-Wombach, Fed. Rep. of Germany

[73] Assignee: Mannesmann Rexroth GmbH, Lohr, Fed. Rep. of Germany

[21] Appl. No.: 184,949

[22] Filed: Apr. 22, 1988

[30] Foreign Application Priority Data

Apr. 29, 1987 [DE] Fed. Rep. of Germany ..... 3714304

[51] Int. Cl.[4] ..... F15B 11/16; F04B 49/00

[52] U.S. Cl. ..... 60/423; 60/431; 60/433

[58] Field of Search ..... 60/422, 423, 431, 433

[56] References Cited

U.S. PATENT DOCUMENTS

| | | | |
|---|---|---|---|
| 3,360,925 | 1/1968 | Zimmerman | 60/423 X |
| 4,118,149 | 10/1978 | Hagberg | 60/431 X |
| 4,400,939 | 8/1983 | Moranduzzo et al. | 60/431 |
| 4,596,118 | 6/1986 | Heiser | 60/431 |
| 4,635,440 | 1/1987 | Kropp | 60/422 |
| 4,716,727 | 1/1988 | Kotter | 60/431 X |
| 4,733,533 | 3/1988 | Deininger et al. | 60/423 X |

FOREIGN PATENT DOCUMENTS

| | | |
|---|---|---|
| 3420990 | of 0000 | Fed. Rep. of Germany . |
| 1227035 | 3/1971 | United Kingdom . |

OTHER PUBLICATIONS

Nikolaus, H. "Hydrostaticher Lenk-und Fahrantrieb fur Kettenfahrzeuge", in *Oilhydraulique und Pneumatik*, 18:9, pp. 667–70, (1974).

*Primary Examiner*—Robert E. Garrett
*Assistant Examiner*—George Kapsalas
*Attorney, Agent, or Firm*—Harness, Dickey & Pierce

[57] ABSTRACT

Speed regulation of pump drive is set by a pressure-regulating valve providing a constant control pressure for a plurality of normal loads. If a high fluid consumption load such as the lifting cylinder of a forklift truck is to be simultaneously actuated the pump speed and net volumetric displacement must be increased. A higher speed-regulating control pressure from the pressure-regulating valve is required. The control valve for the high consumption load has a spool with an extending inclined cam contacting the biasing spring of the pressure-regulating valve. Upon actuation of this control valve the preload of the biasing spring is increased thereby adjusting the speed-regulating control pressure output of the pressure regulating valve. The pump engine or drive speed and the net volumetric displacement are increased.

1 Claim, 1 Drawing Sheet

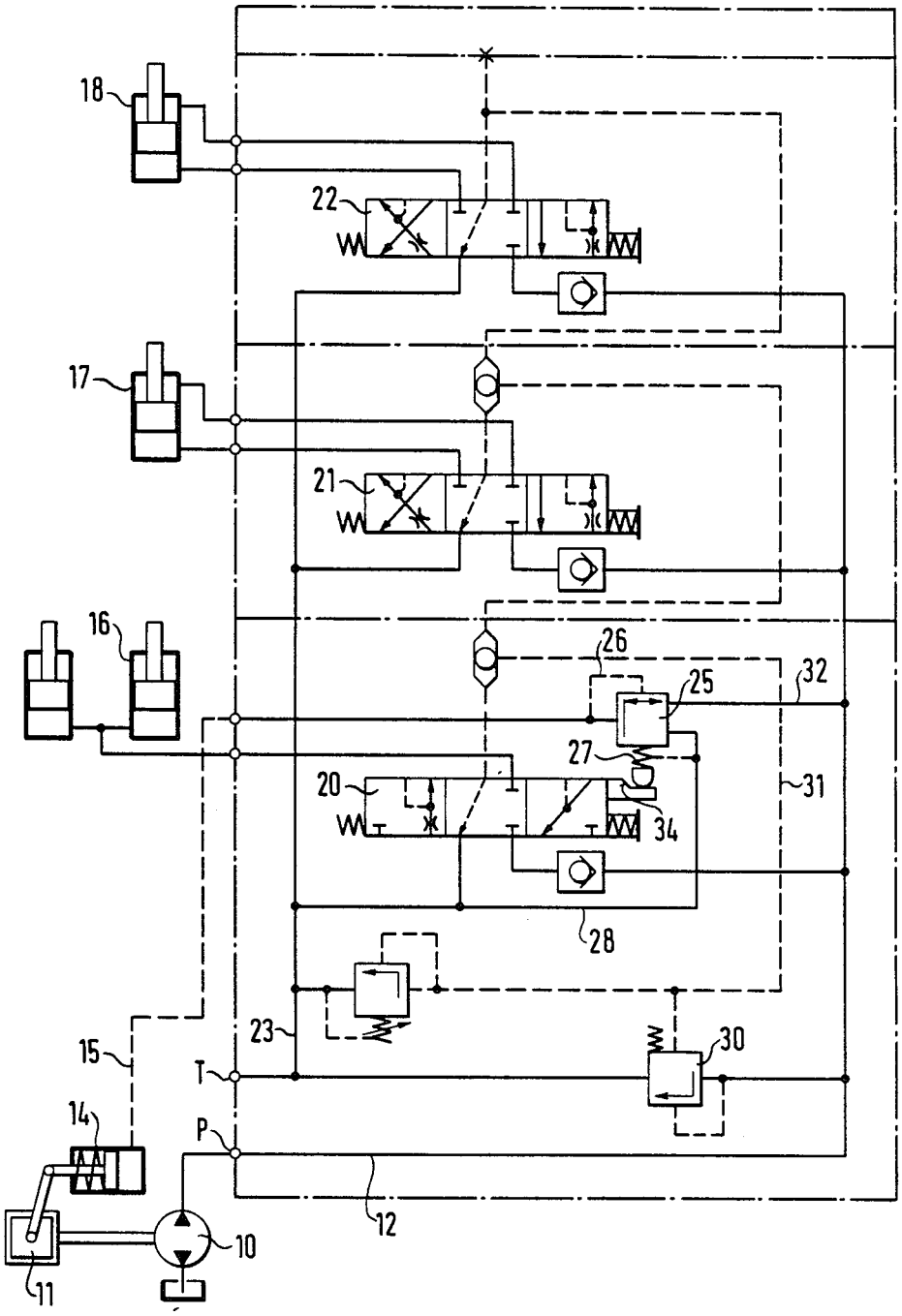
18
22
17
21
16
26
25
32
27
20
31
34
28
23
30
15
T
14
P
12
10
11

PUMP DRIVE SPEED REGULATOR WITH CONTROL-PRESSURE-GENERATING VALVE HAVING SPRING BIASED BY CAM FACE ON LOAD DIRECTIONAL CONTROL VALVE

BACKGROUND OF THE INVENTION

The invention pertains to a valve arrangement for controlling a plurality of loads all supplied by a common engine-driven constant displacement pump.

Such valve arrangements are known (DE-OS 3,443,354 or 3,512,348) and serve to simplify a hydraulic system in so far as to supply the consumers with fluid a constant displacement pump can be used via the speed of rotation of which the volumetric displacement is variable. By the pressure-regulating valve via the actuator cylinder of the speed regulator of the engine or motor driving the constant pump the speed and thus the volumetric displacement is adjusted so that the loads can be adequately supplied with fluid. If however a consumer or load is actuated which has a greater requirement of fluid the pressure-regulating valve must increase the control pressure for the actuator cylinder to increase the pump speed and thus its volumetric displacement. In known manner on deflection of the valve moveable element of the directional control valve controlling said consumer an orifice at the directional control valve is opened through which the control pressure acting on the pressure-regulating valve is decreased to the tank. As a result the pressure-regulating valve is adjusted by its regulating spring and generates the desired higher control pressure for the actuator cylinder of the speed regulator. It is further known to tap the load pressure occurring at the consumer and to conduct it to the pressure-regulating valve in the sense of increasing the control pressure.

The invention provides a simple and reliable solution to the problem of increasing engine or drive speed upon actuation of a specific consumer or consumers.

SUMMARY OF THE INVENTION

A mechanical actuation of the pressure-regulating valve has the advantage that is is independent of the viscosity, i.e. different operating temperatures cannot effect any changes in the control pressure and thus of the speed of rotation. Furthermore, no stability problems arise on changing the speed. Via the adjustment of the spring bias of the pressure-regulating valve the control pressure can be increased with very simple means. The inclined face for actuating the regulating spring can be arranged on an extension of the valve moveable element in such a manner that on deflection of the valve moveable element out of the neutral position the bias of the regulating spring is increased only after a certain travel has been reached, i.e. at a certain cross-section in the operating position. The increase of the bias is effected via the inclined face in dependence upon the stroke of the valve moveable element and consequently a slower or faster rise of the speed with increasing stroke of the valve moveable element can be achieved.

BRIEF DESCRIPTION OF THE DRAWINGS

An example of embodiment of the invention will be explained hereinafter with the aid of the single FIGURE of the drawings in which a valve control block is shown schematically for actuating a plurality of hydraulic cylinders of a forklift truck.

DETAILED DESCRIPTION OF THE PREFERRED EMBODIMENT

A pump 10 is driven by an internal-combustion engine 11 and conveys fluid into a delivery conduit 12. The internal-combustion engine 11 is speed-regulated and for this purpose has an actuator cylinder 14 which is subjected to the control pressure in a control conduit 15. A plurality of hydraulic cylinders of the forklift truck are denoted by 16, 17 and 18 and are connectable via associated directional control valves 20, 21 and 22 to the delivery conduit 12 or to a conduit 23 leading to the tank T. The directional control valves 20 to 22 are combined in a valve block. The hydraulic cylinders 16 are single-action cylinders for actuating the lift platform of the forklift truck.

Associated with the directional control valve 20 is a pressure-regulating valve 25 whose moveable element is subjected via a conduit 26 to the control pressure of the control pressure line 15 and in the opposite sense to the force of a spring 27. The moveable element of the pressure-regulating valve is thus adjusted by the control pressure against the spring 27 in the sense of a reduction of the control pressure in the conduit 15 in that the latter is increasingly connected to a conduit 28 leading to the tank whereas with decreasing control pressure the spring 27 adjusts the piston so that the connection of the control pressure conduit 15 to the pump delivery conduit 12 is increasingly opened.

The mode of operation is as follows: as long as none of the directional control valves is actuated the fluid forced by the pump 10 into the conduit flows via a pressure-reducing valve 30 to the tank T because the pressure-reducing valve 30 opens when the load pressure report line 31 is pressure-less in the neutral position of the directional control valves. There is also no control pressure in the control pressure conduit 15 so that the pump 10 is driven only with the idling speed of the motor 11.

If one or both of the directional control valves 21, 22 is brought into the working position the pressure-reducing valve 30 closes via the load pressure report line 31 and pressure can build up in the delivery conduit 12. The pressure-regulating valve 25 is subjected to the action of the regulating spring 27 in such a manner that via the connection of the conduit 32 to the control pressure conduit 15 pressure is built up in the latter so that the actuator cylinder 14 is moved and the speed of the engine 11 increased. Once a predetermined control pressure has been reached pressure equilibrium is present at the pressure-regulating valve. The pressure preselected at the regulating spring 27 is thus kept constant in the conduit 15 independently of the pump pressure. The pump speed is thus set so that an amount of fluid adequate to actuate the consumers 17, 18 is displaced.

If the directional control valve 20 associated with the pressure-regulating valve 25 is now brought into the working position to actuate the consumer 16 the control pressure in the conduit 15 must be increased to increase the speed of the pump and thus correspondingly increase the volumetric displacement. For this purpose the biasing of the regulating spring 27 of the pressure-regulating valve 25 is increased by an inclined face 34 provided on the piston of the directional control valve 20. This increases the control pressure in the conduit 15 and results in a corresponding speed increase of the pump 10. The inclined face 34 for mechanical adjustment of the regulating spring 27 is arranged on the moveable element of the directional control valve 20 in such a manner that the spring bias is only increased when the directional control valve is adjusted in the lifting direction of the consumer 16. Furthermore, the inclined face 34 may be arranged so that the spring bias is not increased until the directional control valve moveable element has executed a predetermined initial stroke travel. Via the steepness of the inclined face 34 the rate of increase of the speed with increasing travel of the directional control valve moveable element can be selected. As a result, in the fine control range of the directional control valve 20 no speed increase for performing a lift movement of the consumer 16 takes place, this beginning only when the directioal control valve is brought from the fine control range into the actual working position in which a load is to be rapidly raised.

I claim:

1. Valve arrangement comprising a pump driven by a motor, a speed regulator for said motor actuated by an actuator cylinder for setting the volumetric output of said pump by changing the speed of said motor, a plurality of directional control valves for controlling the fluid paths between a delivery of said pump, a tank and a plurality of consumers, a pressure-regulating valve associated with one of said directional control valves and connected to the pump delivery line, to the tank and to a line leading to said actuator cylinder for maintaining constant a predetermined control pressure corresponding to a specific motor speed as long as one or more of the remaining directional control valves is actuated and by which the control pressure is increased to increase the motor speed when the directional control valve associated with the pressure-regulating valve is actuated, said pressure-regulating valve being subjected in one sense to the control pressure and in the opposite sense to a regulating valve being subjected in one sense to the control pressure and in the opposite sense to a regulating spring, characterized in that means are provided for adjusting the pressure set by said pressure-regulating valve by varying the bias of said regulating spring, said means for adjusting the pressure comprising an included cam face engaged with said regulating spring for adjusting the preload of said regulating spring and means for mechanically coupling said cam face to the moveable element of said associated directional control valve for operation upon operation of the associated directional control valve.

* * * * *